US006179527B1

(12) United States Patent
Goughnour

(10) Patent No.: US 6,179,527 B1
(45) Date of Patent: Jan. 30, 2001

(54) APPARATUS FOR INSERTING FLEXIBLE MEMBERS INTO THE EARTH

(76) Inventor: R. Robert Goughnour, 705 Duff Rd. NE., Leesburg, VA (US) 20176

( * ) Notice: Under 35 U.S.C. 154(b), the term of this patent shall be extended for 0 days.

(21) Appl. No.: 09/285,738

(22) Filed: Apr. 5, 1999

(51) Int. Cl.[7] ..... E02D 7/00; E02D 7/18; E02D 7/26

(52) U.S. Cl. ..... 405/232; 74/89.1; 74/89.11

(58) Field of Search ..... 405/182, 232; 74/89.1, 89.11

(56) References Cited

U.S. PATENT DOCUMENTS

| | | | | |
|---|---|---|---|---|
| 3,891,186 | | 6/1975 | Thorsell | 254/29 |
| 4,755,080 | | 7/1988 | Cortlever et al. | 405/50 |
| 5,213,449 | | 5/1993 | Morris | 405/232 |
| 5,439,326 | | 8/1995 | Goughnour et al. | 405/303 |
| 5,507,512 | * | 4/1996 | Donoghue | 280/217 |
| 5,658,091 | | 8/1997 | Goughnour et al. | 405/50 |
| 6,039,508 | * | 3/2000 | White | 405/232 |

FOREIGN PATENT DOCUMENTS 7707303 7/1977 (NL) .

* cited by examiner

*Primary Examiner*—David Bagnell
*Assistant Examiner*—Sunil Singh
(74) *Attorney, Agent, or Firm*—Carothers & Carothers

(57) ABSTRACT

Apparatus for inserting flexible members such as tie-back anchors for slope stabilization or prefabricated vertical drains into underlying earth which includes an articulatable mast to be arranged with a generally upright extent above the underlying earth. An elongated earth penetrating tube or mandrel is carried by the mast for guided movement therealong and for receiving a flexible member for movement with the mandrel to insert the flexible members into the underlying earth. A drive is mounted on the mast and engaged with this mandrel for driving the mandrel into and out of the underlying earth. A vibrator assembly is mounted for imparting vibrations to the mandrel to assist movement of the mandrel in underlying earth when a vibrator is energized. The vibrator assembly includes a circular gear mounted for concentric rotation on an axis and supported for rotation about its axis on a frame carried by the vibrator. This gear is meshed with a gear rack on the mandrel for imparting vibrations to the mandrel through the gear and a flywheel mass is engaged with this gear for simultaneous rotation therewith to impart increased rotational mass momentum to the gear.

7 Claims, 5 Drawing Sheets

APPARATUS FOR INSERTING FLEXIBLE MEMBERS INTO THE EARTH

BACKGROUND OF THE INVENTION

This invention relates generally to apparatus for inserting flexible members, such as tie-back anchors for slope stabilization or prefabricated vertical (PV) drains (sometimes referred to as wick or band drains) into the earth, and more particularly to an improved apparatus for inserting such members into dense or hard soil layers.

One well known technique for improving soft, saturated soil, such as wet clay, for example, is to drive into the soil a drainage element (PV drain) that penetrates deep into the soil with the top end of the drainage element maintained above the surface of the soil. The PV drain is formed of any suitable material which is water permeable, or perforated to be water permeable, so that the water in the soil can penetrate the walls of the drain and flow upwardly therein, to the surface of the soil as a result of water pressures in the soil beneath the surface. It is common practice in such situations to increase these inherent water pressures in the soil by placing a layer of earth on top of the wet soil so that the weight thereof will assist in forcing the water into and upwardly through the PV drains, where it can be readily disbursed.

The PV drain is generally elongated and flexible and it is carried into the ground by utilizing a rigid insertion tube or mandrel formed of suitable metal. This insertion tube, together with the drain contained therein, is driven downwardly into the earth to the desired depth and then the insertion tube is pulled out of the soil thereby leaving the PV drain. The drains are inserted at regular predetermined intervals in the earth, depending upon soil conditions and moisture content.

This rigid insertion tube or mandrel, which carries the elongated, flexible PV drain therein, is adapted for vertical movement within a mast. The insertion tube is forcibly driven into the earth, and then pulled out by any one of different known drive systems. For example, in Dutch Patent No. 7,707,303, there is disclosed a drive arrangement which uses a vibratory driver that engages the top portion of the insertion tube for driving the bottom end of the insertion tube into the earth. In Cortlever, U.S. Pat. No. 4,755,080, a combination of hydraulic cylinders and a cable drive that engages the insertion tube at the upper end thereof is utilized, and a somewhat similar hydraulic motor and chain drive is disclosed in Thorsell U.S. Pat. No. 3,891,186.

In general, most of these prior art arrangements engage and drive the insertion tube at its top end, requiring a relatively heavy mast and boom arrangement to support the insertion tube or mandrel and the drive mechanism. This not only increases the weight of the apparatus, but also increases the cost of fabrication as well as maintenance.

It is also known to utilize vibratory means in combination with cable or chain drives. These rigs are commonly referred to as vibro/static machines. In these machines a vibrator is mounted to the top of the mandrel to impart vertical vibration to the mandrel. Elastomers placed between the mandrel and the drive (chain, cables etc.) isolate the vibrations from the drive and mast. From a geotechnical standpoint, it is preferable to install wick drains without the use of vibration, since such vibration can remold the soil in close proximity with the mandrel, resulting in loss of strength and decreased permeability. Lower permeability of the soil in this region impedes the flow of water into the drain, requiring longer surcharge periods. However, vibration greatly enhances the ability of the apparatus to penetrate the ground, and it is often necessary to penetrate through dense or hard soil layers to reach an underlying soft soil layer. These layers are often so hard that it is not possible to penetrate them without the use of a vibratory system. The combination machines (vibro/static) are very useful in these cases, since the vibration can be turned on only during penetration through the hard layers. Further, vibrating the mandrel induces very high vibratory stresses, and fatigue of the mandrel material becomes a problem.

It is also known that the insertion tube can be driven into the earth utilizing a pair of friction rollers positioned just above the surface of the earth, these rollers being formed of a material that will frictionally engage the side walls of the insertion tube disposed therebetween with the frictional engagement between the rollers and the insertion tube, thus driving the insertion tube into the ground. This prior art friction roller arrangement overcomes the problem of engaging the insertion tube at its upper end, but suffers from a tendency of the friction rollers to slip when the mandrel or insertion tube is covered with wet, slippery soil material which adheres to the mandrel. The Morris Patent (U.S. Pat No. 5,213,449) overcomes this problem by utilizing a drive gear to positively engage a flange or fin which is attached to and coextends with the mandrel. This flange contains rack gear mesh openings spaced along its length, which the teeth of the drive gear engage. This arrangement is similar to a rack and pinion arrangement. These bottom-drive arrangements overcome the need to engage the mandrel at its top end, and require a mast sufficient to support the mandrel only. They cannot, however apply vibration to the mandrel for added penetrating ability.

Goughnour and Joiner (U.S. Pat. No. 5,658,091) disclose a vibro/static system whereby a vibratory driver is positioned at and attached to the upper end of the mandrel for imparting vibrations to assist in its penetration. A drive which includes a rotary drive gear, that engages a mandrel/fin, and a motor for driving the gear is mounted at the bottom of the mast as with the Morris Patent. A flexible torsion coupler between the motor and the drive gear isolates the motor and the mast from vibrations imparted to the mandrel by the vibrator. Although this system does not require static crowd engagement of the mandrel at its top end, the mast must be structurally sufficient to support the vibratory driver that travels to the top of the mast.

These same techniques are also utilized for inserting other flexible members into the earth, such as tie back anchors for slope stabilization.

The present invention discloses means to add vibratory capability to the bottom-drive apparatus of the friction roller type or of the type disclosed in the Morris or Goughnour/Joiner patents, wherein the vibratory driver is mounted to, and remains at the lower end of the mast. This permits application of vibrations to the mandrel either intermittently or constantly as required, but does not require the heavy mast structure to support a vibratory driver that travels to the top end of the mast.

SUMMARY OF THE INVENTION

The apparatus of the present invention for inserting flexible members downwardly into the earth, such as flexible tie backs or flexible drain members, includes an articulatable mast to be arranged above the underlying earth and an elongated earth penetrating mandrel carried by the mast for guided movement along the mast. The mandrel receives a flexible member for movement with the mandrel to insert flexible members in the underlying earth.

In typical fashion, a drive is mounted on the mast and engaged with the mandrel for driving the mandrel into and out of the underlying earth and a vibrator is mounted to impart vibrations to the mandrel to assist movement of the mandrel in the underlying earth when the vibrator is energized.

The improvement of the present invention resides in a vibrator which includes a circular gear mounted for concentric rotation on its axis and supported for rotation about its axis on a frame that is carried by the vibrator. The vibrator is arranged to vibrate in a direction parallel to the axis of the mandrel. Thus, the gear, supported on its axis, must also vibrate in a direction parallel to the axis of the mandrel. The gear is meshed with a rack on the mandrel for imparting vibrations to the mandrel through the gear. A flywheel is engaged with this gear for simultaneous rotation with the gear to impart increased rotational momentum to the gear.

If the mass moment of inertia of the gear is small, its vibration in a direction parallel to the axis of the mandrel will be accommodated principally by vibratory rotation about its own axis, instead of forcing the mandrel to vibrate parallel to its own axis. Very little vibratory energy will be imparted to the mandrel. The purpose of adding the flywheel is to increase the mass moment of inertia of the flywheel/gear combination, thus increasing the vibratory energy imparted to the mandrel.

The amount of vibratory energy imparted to the mandrel depends on the dynamic characteristics of the vibrator, the total mass of the vibrator/gear assembly, the mass moment of inertia of the gear/flywheel combination, and the mass of the mandrel.

Although the circular gear utilized for imparting vibrations to the mandrel is preferably left free-wheeling, it may also be simultaneously employed by the mandrel drive, sometimes referred to as the static drive. In this case the drive is connected directly to this vibrator gear for driving the mandrel into and out of the underlying earth with the gear, as well as utilizing the gear for imparting vibrations to the mandrel.

It is still desirable that the rotational mass moment of the gear be relatively large. If the rotational mass momentum of the vibratory drive gear were small, the only resistance to its rotational vibration would have to be provided by the static drive motor. The static drive motor or motors would not only be subjected to overall physical vibration, but would also need to resist the rotational vibration applied to their shafts. These constraints would probably limit the choice of drive motors to the direct drive hydraulic type.

Normally such motors are hydraulically driven utilizing flexible hoses from the pump power source. Such hoses have sufficiently large elastic expansion capability that rotational vibration could easily be absorbed by their vibratory expansion, and vibratory energy transmission to the mandrel would be very inefficient. It may be possible to design the hydraulic system with sufficient rigidity to resist this expansion, but then the problem would be that very large hydraulic pressure spikes would be produced. Such spikes would be very detrimental not only to oil seals in the motor, but to all components throughout the hydraulic system. For efficient operation the flywheels are still required.

By utilizing the flywheels to resist rotational vibration the requirements for drive motors are greatly relaxed. To further reduce the dynamic stresses applied to the drive motor or motors, it is desirable to utilize a flexible drive coupling between the motor and the member driven by the motor. This coupling may take the form of a flexible torsion coupler as shown in U.S. Pat. No. 5,658,091, or it may take the form of other flexible drives such as a chain drive.

The vibrator may be mounted to the mast or may be mounted directly to the static drive assembly. In either situation the vibrating assembly must be mounted on elastomer mounts for isolating the mast and other non-vibrating parts from vibrations generated by the vibrator and applied to the mandrel.

If vibration and static crowd are both applied to the same gear, the elastomers must be sufficiently stiff to withstand the static crowd force without unduly large deformation. Such stiff elastomers are less efficient in isolating vibration from the rest of the structure. In the case where the vibration is applied to a free-wheeling gear/flywheel arrangement the elastomers need not withstand these large static forces, and need only to support the static weight of the vibrator assembly. The elastomers can be very soft in this latter situation. Vibration isolation is much more efficient with this arrangement.

BRIEF DESCRIPTION OF THE DRAWINGS

Other objects and advantages appear hereinafter in the following description and claims. The accompanying drawings show, for the purpose of exemplification, without limiting the invention or the appended claims, certain practical embodiments illustrating the principals of this invention wherein:

DESCRIPTION OF THE PREFERRED EMBODIMENTS

Figure 1:
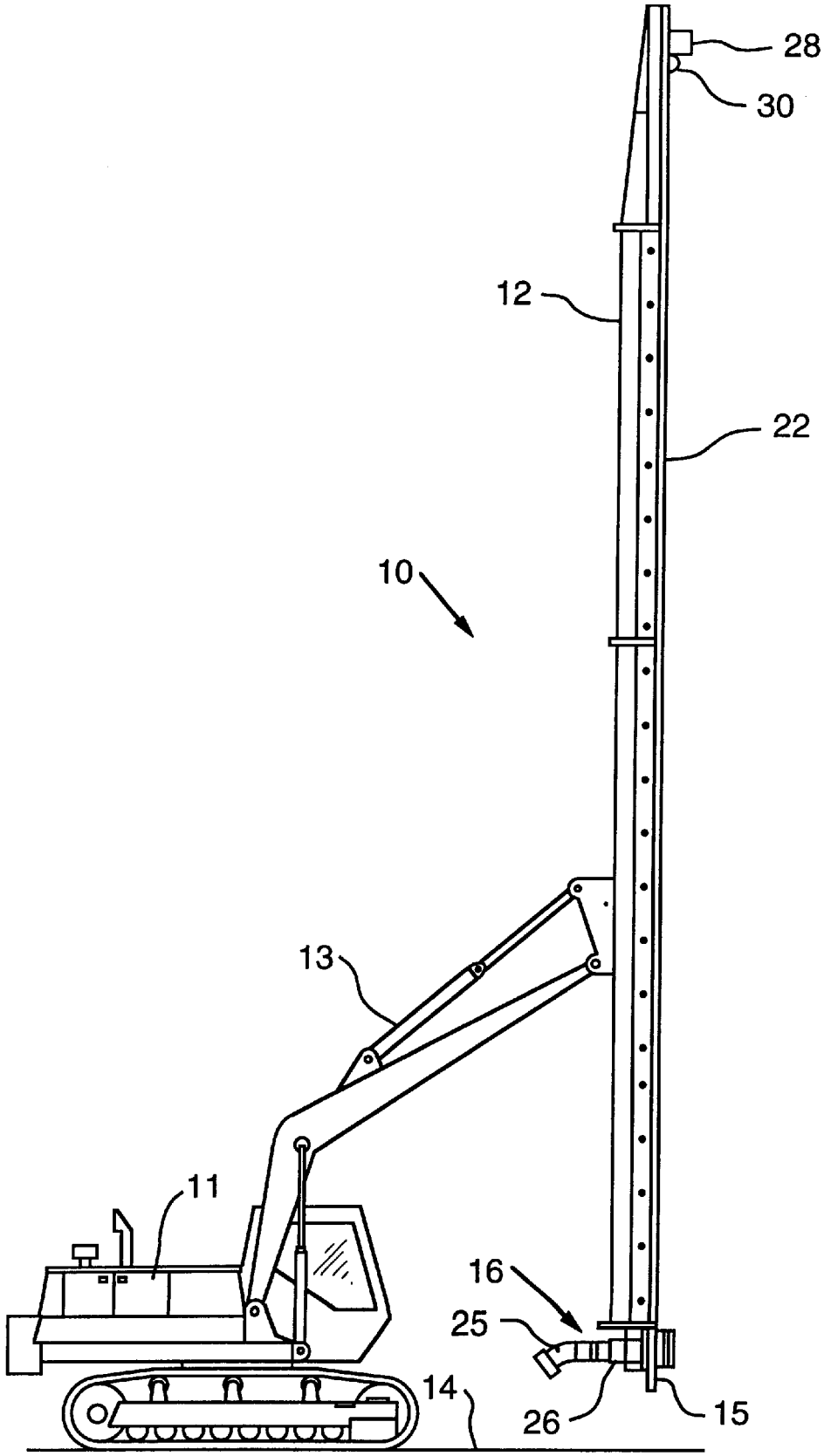
FIG. 1 Prior Art
FIG. 1 is a general overall view in side elevation illustrating prior art apparatus for installing prefabricated vertical drains and wherein the vibrator is mounted at the top of the mandrel.
Figure 1A:
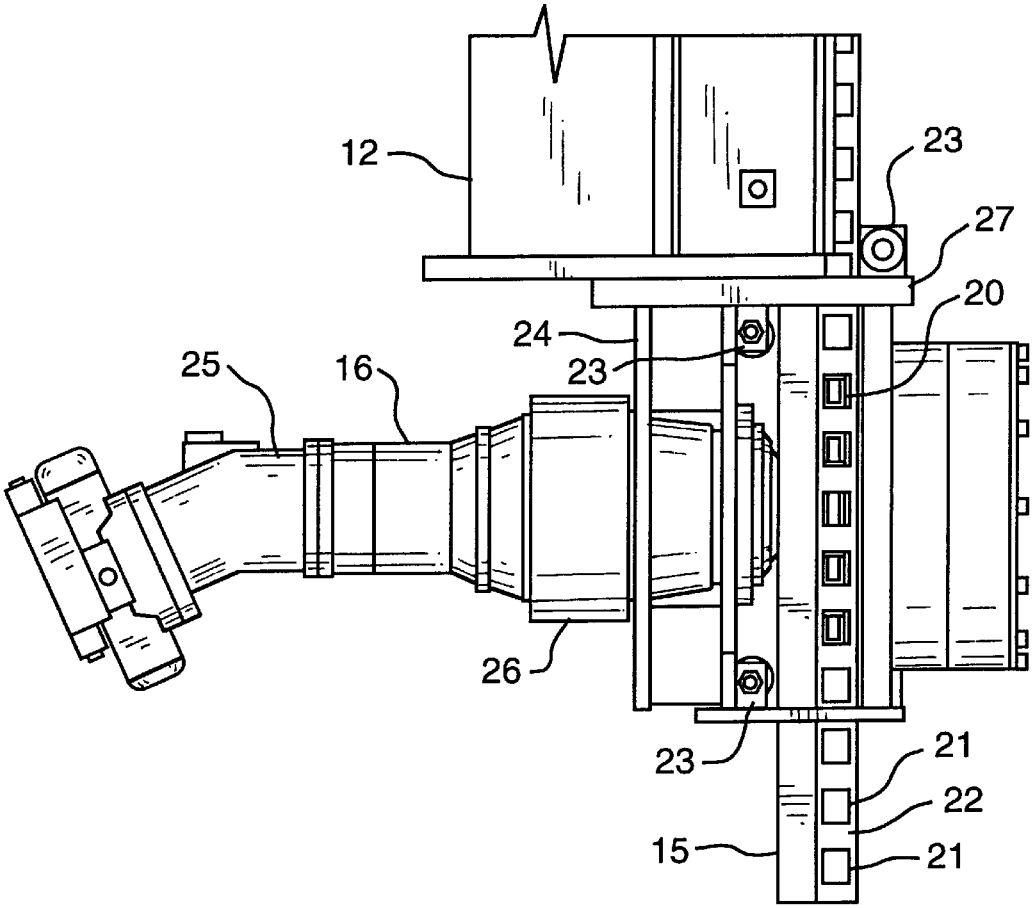
FIG. 1A Prior Art
FIG. 1A is an enlarged view of the drive structure shown at the bottom of the prior art apparatus of FIG. 1.

Referring to FIGS. 1 and 1A, the drain inserting apparatus 10 of the prior art is supported by a motorized vehicle or tractor 11, which may be of any suitable conventional type, and supports and manipulates the mast 12 with hydraulically operated manipulating arms 13. The mast 12 may be manipulated by arm 13 such that it extends generally upright above or perpendicular to the underlying earth 14 as shown in FIG. 1.

An elongated earth penetrating mandrel 15 is carried within hollow tubular mast 12 for vertical movement relative to mast 12. Mandrel 15 is a hollow insertion tube which is adapted to receive a drain member therein for movement with the mandrel in order to insert the drain members or other flexible members into the underlying soil 14 in exactly the same manner as is described in Morris U.S. Pat. No. 5,213,449.

In similar fashion to the drive mechanism disclosed in Morris, the drive mechanism 16 of the present invention is mounted on mast 12, adjacent the lower end thereof, for driving mandrel 15 into and out of underlying earth 14. This drive includes a rotary drive gear 20 which engages the aligned rack gear openings 21 of mandrel fin or flange 22 in rack and pinion fashion to vertically drive mandrel 15 as described in detail in the Morris Patent. The support rollers 23 are rotatably carried on the drive housing 24 to hold the flange 22 against drive gear 20.

The drive 16 includes a suitable hydraulic reversible drive motor 25 and a speed reduction planetary gear box 26 of the type described in the Morris Patent. The motor and gear box are mounted to the rear portion of the drive 16 as viewed in FIG. 1 and as shown in detail in FIG. 1A, and is supported and mounted directly to mast 12 by mount 27. Gear box housing 26 and drive 16 in general are also supported on the lower end of mast 12.

Vibrator 28 is mounted on flange or fin 22 of mandrel 15 adjacent the upper end of mandrel 15. Vibrator 28 is rigidly secured to shelf 30 which in turn is directly attached as by welding to mandrel 15 via the extending flange 22, which is exposed through a side channel opening of tubular mast 12.

The drive box 16 at the lower end of mast 12 is modified to isolate vibration of the mandrel 15 from the mast 12 and the carrier vehicle 11 as with the Goughnour/Joiner patent. The vibration damping component is comprised of a flexible torsion drive coupler 17 which couples drive gear box 26 to drive gear 20 to in turn vertically drive mandrel 15 and yet isolate motor 25 and gear box 26, and for that matter other associated parts of the apparatus 10, from vibration imparted to mandrel 15 by vibrator 28.

Figure 3:
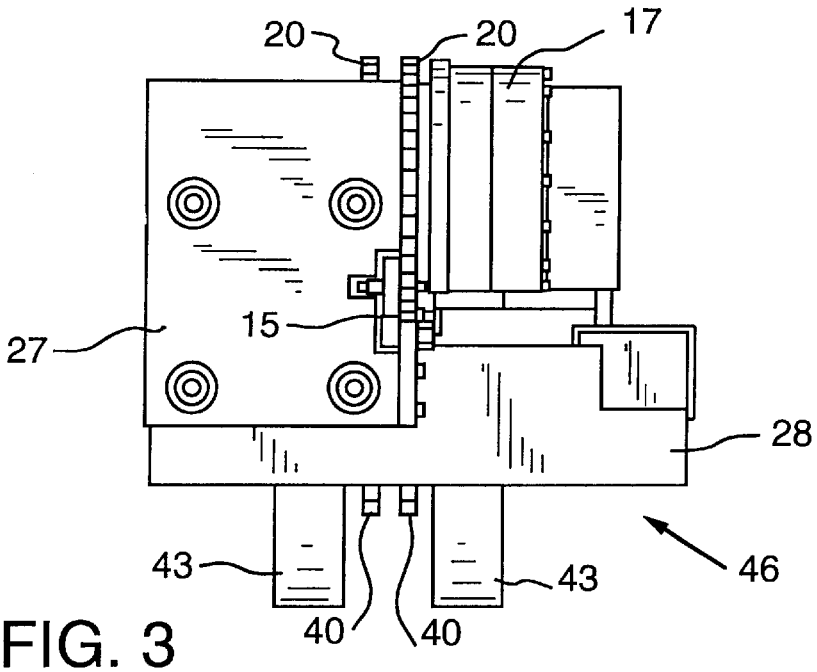
FIG. 3 is a top view of the combination static drive and vibrator structure shown in FIG. 2 and rotated to the left by 90°.

The flexible torsion drive coupler 17 is not specifically illustrated since it is fully illustrated in the prior art as seen specifically as drive coupler 34 illustrated in FIG. 3 of U.S. Pat. No. 5,658,091. These torsion couplers are commercially available per se on the market and are manufactured by Lord Industrial Products.

Figure 2:
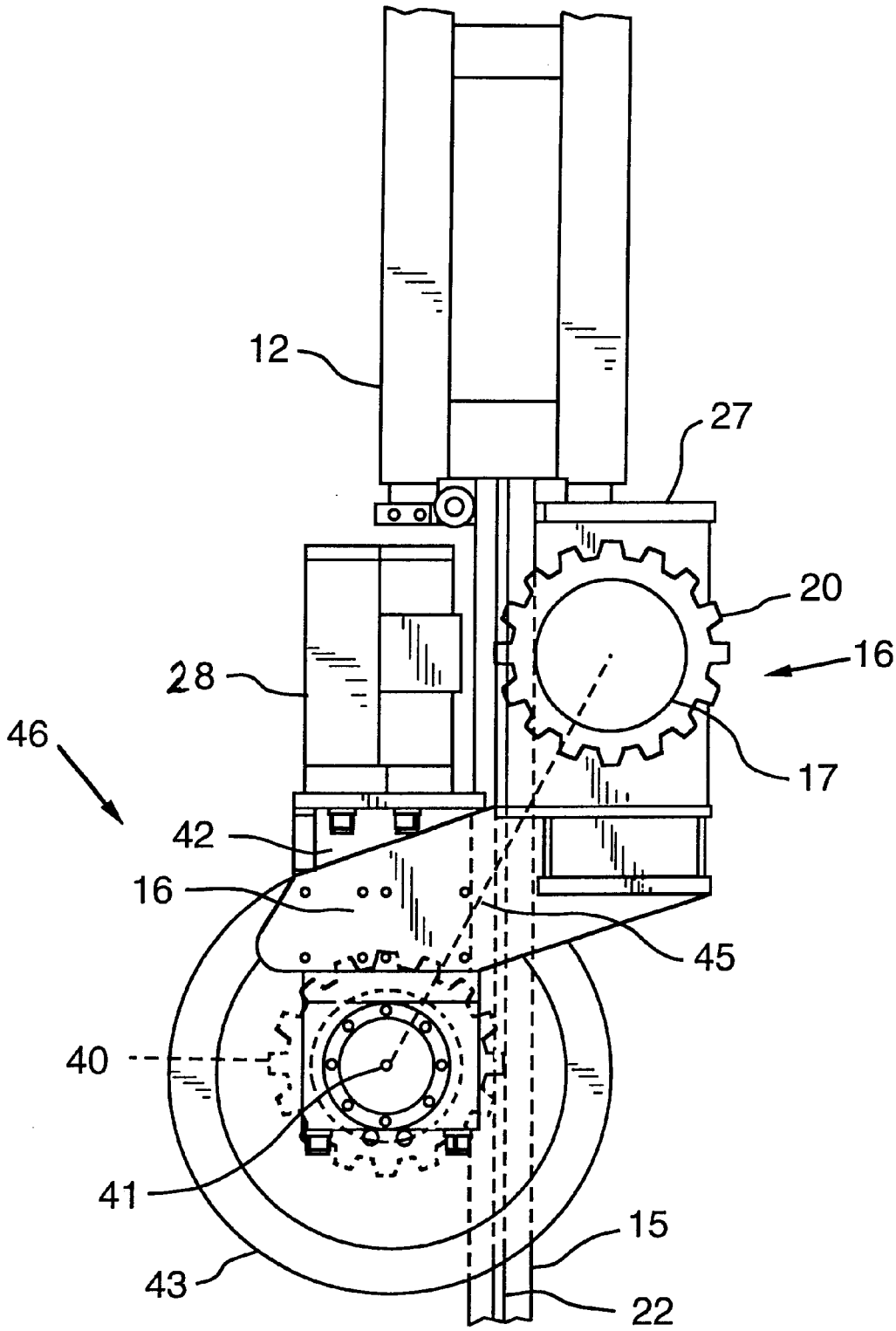
FIG. 2 is an enlarged detailed view illustrating the mandrel drive mechanism and vibrator both mounted at the bottom of the mast structure in accordance with the teachings of the present invention.
Figure 4:
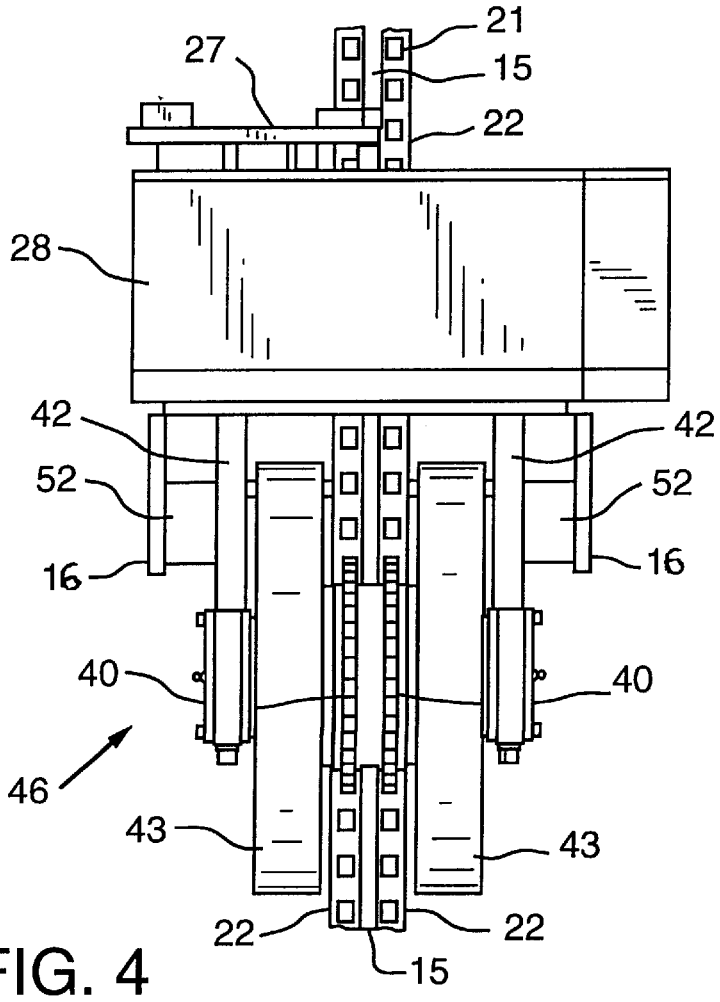
FIG. 4 is a view in left front elevation of the combination static drive and vibrator structure shown in FIG. 2.

FIGS. 2, 3 and 4 illustrate details of the present invention pertaining to the vibrator 28.

The vibrator assembly 46 includes a circular gear 40 mounted for concentric rotation on an axis 41 and supported for rotation about its axis 41 on frame 42 attached to vibrator 28. Circular gear 40 is meshed with the gear rack flange 22 on mandrel 15 for imparting vibrations to the mandrel through gear 40.

A flywheel 43 is coaxially engaged with gear 40 for simultaneous rotation therewith to impart increased rotational mass momentum to the gear 40 and thereby also to mandrel 15.

In FIGS. 2 through 4, the flywheel 43 and the gear 40 is shown in the form of dual flywheels 43 and dual circular gears 40 for uniformly driving mandrel 15 into and out of the underlying earth in a balanced manner with dual racks or flange 22. However, a single gear rack flange 22 and a single flywheel 43 and circular gear 40 may be utilized if desired.

Additionally, flywheel 43 does not necessarily have to be coaxially mounted with circular gear 40 and may be coupled thereto through any other conventional arrangements wherein their respective axes are not coaxial, but remain in parallel such as a gear drive.

Vibrator gear 40 may in and of itself also be utilized as the drive gear 20 for driving the mandrel 15 into and out of the underlying earth while being simultaneously also utilized for imparting the required vibrations to the mandrel 15 when the vibrator 28 is energized. This is illustrated in FIG. 2 by dashed line 45 which diagrammatically indicates direct mechanical drive between drive 16 and gear 40 as an alternative, thereby eliminating static drive gear 20.

In either situation, the static drive 16 is provided with a flexible drive coupling as previously explained, and in addition, the vibrator 28 is also mounted with elastomers 52 in order to additionally isolate vibrations from being imparted to mast 12 and to the housing of drive 16.

Figure 5:
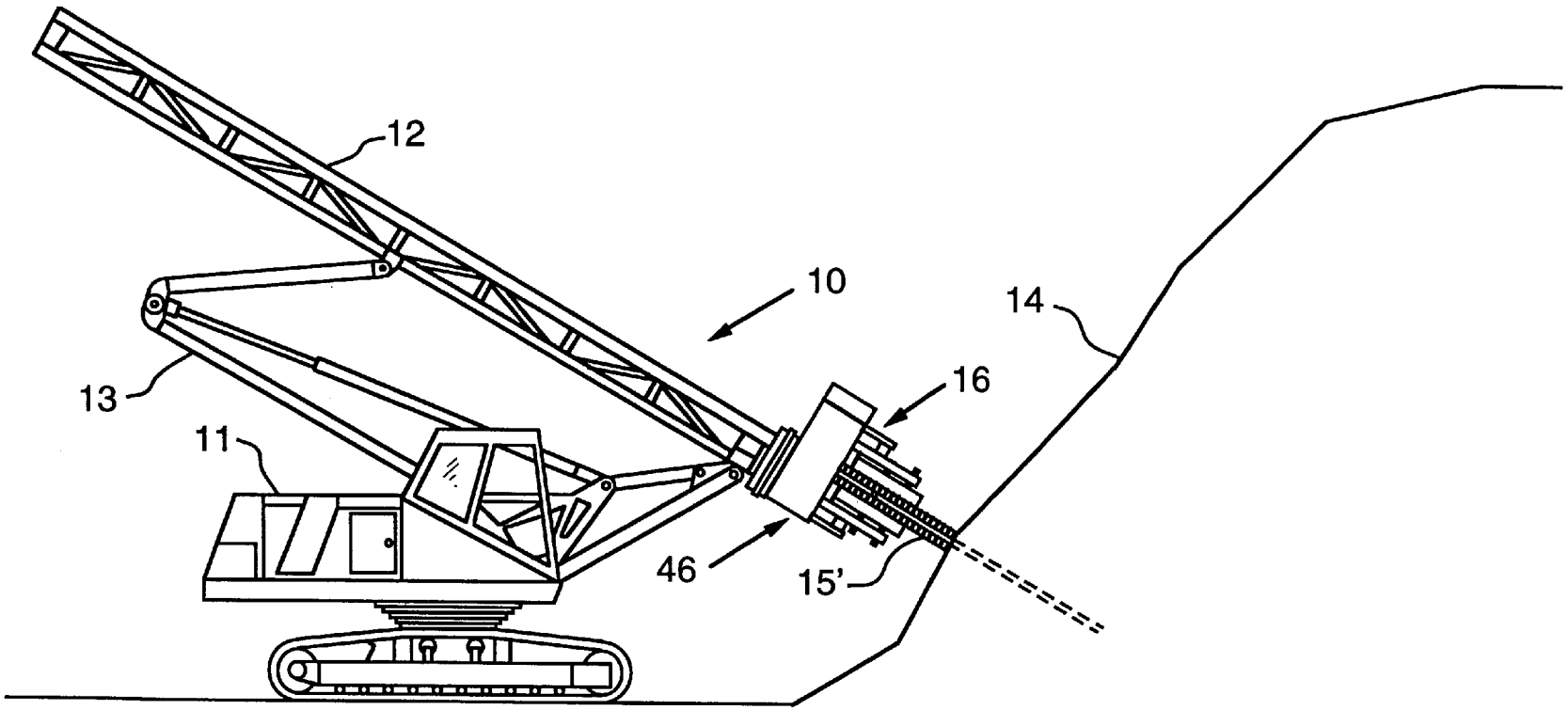
FIG. 5 is a general overall view in side elevation illustrating the apparatus of the present invention adapted for installing tie-back anchors for slope stabilization.

Referring next to FIG. 5, the apparatus 10 of the present invention is illustrated as being adapted for installing tie-back anchors for slope stabilization. Identical or similar elements are designated with the same reference numerals as the elements in FIG. 1.

The apparatus 10 illustrated in FIG. 5 operates in substantially identical fashion to the apparatus illustrated in FIG. 1 except that the manipulating arm mechanism 13 is here adapted to hold the mast structure 12 in a more horizontal position for driving the tie-back anchor mandrel 15' into the underlying earth 14 of the slope to be stabilized instead of driving a mandrel 15 with its contained PV drain member as described in conjunction with the apparatus of FIG. 1. Further the vibrator of the present invention is located at the bottom of the mast. Structural requirements on the mast are therefore much reduced.

The vibrator 28 for the apparatus 10 illustrated in FIG. 5 is in all respects identical to the vibrator particularly disclosed and described in conjunction with FIGS. 2 through 4.

I claim:

1. An apparatus for inserting flexible members downwardly into underlying earth, said apparatus including:

an articulatable mast to be arranged above underlying earth;

an elongated earth penetrating mandrel carried by said mast for guided movement therealong and for receiving a flexible member for movement with said mandrel to insert flexible members in underlying earth;

a drive mounted on said mast and engaged with said mandrel for driving said mandrel into and out of underlying earth;

a vibrator mounted for imparting vibrations to said mandrel to assist movement of said mandrel in underlying earth when said vibrator is energized;

the improvement comprising said vibrator including a circular gear mounted for concentric rotation on an axis and supported for rotation about its axis on a frame carried by said vibrator and meshed with a gear rack on said mandrel for imparting vibrations to said mandrel through said gear; and flywheel mass engaged with said gear for simultaneous rotation therewith to impart increased rotational mass momentum to said gear for thereby transmitting vibratory forces from said vibrator to said mandrel through inertial reaction force.

2. The apparatus of claim 1, wherein said drive is connected to said vibrator circular gear for driving said mandrel into and out of underlying earth with said gear.

3. The apparatus of claim 2 including a flexible drive coupling between said drive and said circular gear for isolating said drive from vibrations generated by said vibrator.

4. The apparatus of claim 1, said drive including a drive motor and a drive member driven by said motor and engaging said mandrel for driving said mandrel, and a flexible drive coupling disposed between said motor and said drive member for isolating said motor from vibrations generated by said vibrator.

5. The apparatus of claim 1 wherein said vibrator is mounted to said mast with elastomer mounts for isolating said mast from vibrations generated by said vibrator.

6. The apparatus of claim 5 wherein said vibrator is mounted to a bottom portion of said mast.

7. The apparatus of claim 1 wherein said gear and said flywheel are coaxially coupled.

* * * * *